United States Patent [19]

Powell et al.

[11] 4,402,566

[45] Sep. 6, 1983

[54] FIELD REPAIRABLE ELECTRICAL CONNECTOR

[75] Inventors: Lloyd J. Powell, Newmarket; John B. Gerow, Oshawa, both of Canada

[73] Assignee: International Telephone & Telegraph Corporation, New York, N.Y.

[21] Appl. No.: 310,633

[22] Filed: Oct. 13, 1981

[51] Int. Cl.[3] ..... H01R 13/58

[52] U.S. Cl. ..... 339/103 M; 339/217 R; 339/94 M

[58] Field of Search ..... 339/103 R, 103 M, 89–90, 339/94 R, 94 M, 206 R, 210 RM, 217 R, 217 S

[56] References Cited

U.S. PATENT DOCUMENTS

| | | | |
|---|---|---|---|
| 3,351,886 | 11/1967 | Zimmerman | 339/90 R |
| 3,824,681 | 7/1974 | Clark | 339/90 R X |
| 3,848,950 | 11/1974 | McCormick et al. | 339/90 R |
| 4,264,116 | 4/1981 | Gliha | 339/90 R |

*Primary Examiner*—Eugene F. Desmond

*Attorney, Agent, or Firm*—T. E. Kristofferson; T. L. Peterson

[57] ABSTRACT

A geophysical connector is disclosed which may be utilized in extreme climatic conditions that is readily field repairable without disrupting the sealing characteristics of the connector. The connector employs an auxiliary harnessing system for coupling the conductors of a cable to the contacts of the connector.

8 Claims, 10 Drawing Figures

FIELD REPAIRABLE ELECTRICAL CONNECTOR

BACKGROUND OF THE INVENTION

The present invention relates generally to an electrical connector and, more particularly, to a field repairable connector which is suitable for use in hostile environments.

Environmental type connectors are utilized by the geophysical industry throughout the world. Typical climatic operaing conditions for such connectors includes the severe cold of the Arctic, the moisture and dampness of tropical regions and the arid dryness and dusty conditions of desert localities. Most environmental connectors of the type suitable for such environments, once they are coupled to the conductors of the cable, are extremely difficult if not impossible to repair should an accident occur in the field damaging or destroying any element of the connector contact and/or harnessing system. In the majority of instances the cable must be severed by a technician and the entire connector is scrapped, sometimes foreshortening the cable to such an extent that even in another connector is connected to the cable, the cable is not sufficiently long to allow such connector to engage with a mating connector on a second cable. Under these circumstances, unless replacement cable assemblies are immediately available, particularly in the case of remote exploration crews, the entire project may be shut down resulting in substantial losses.

In one environmental connector which has been utilized for geophysical applications, it is necessary to remove the front elastomeric insulator from the connector shell in order to remove and replace contacts mounted in the insulator and to connect cable conductors to the contacts. The elastomeric insulator is initially compression mounted in the barrel of the connector to provide a seal therebetween. Removal of the insulator from the barrel to allow replacement of the contacts causes the seal to be broken, which cannot always be reestablished when the insulator is remounted in the barrel. In addition, repair and replacement of contacts and the connection of the cable conductors to the contacts in the field is time consuming and sometimes difficult to perform.

U.S. Pat. No. 4,221,447 discloses a high temperature hermetic electrical connector in which the contacts of the connector are permanently sealed in a ceramic insulator which in turn is sealed to the wall of the connector shell so that the insulator is not removable therefrom. The contact bodies may not be removed from the insulator, and the insulator cannot be removed from the shell in the field, thus making replacement of the contact bodies impossible in the field. This patent discloses a rear harnessing system for simultaneously coupling the cable conductors to the rear of the contact bodies in the front ceramic insulator. The harnessing arrangement is not entirely practical for geophysical applications requiring very large number of contacts to which the conductors of the cable must be harnessed.

Accordingly, it is the object of the present invention to provide an improved environmental connector which may withstand hostile environments yet which permits quick and reliable emergency field repair in the event of damage to or destruction of any element of the primary contact or harnessing system, without impairing the sealing characterisitcs of the connector.

SUMMARY OF THE INVENTION

According to a principal aspect of the present invention, there is provided an environmental connector similar to the prior geophysical connector discussed above except that there is provided an extra set of insulator discs for accurately supporting harnessing terminals which interconnect the conductors of the cable with the contacts mounted in the front elastomeric insulator. The insulators mounted in the connector behind the front elastomeric insulator all have a free sliding fit within the barrel of the connector so that such insulators may be removed without requiring the front elastomeric insulator to be shifted rearwardly so that the seal between the front insulator and the barrel is not disturbed. Preferably the rear sections of the contacts have spring sleeves mounted thereon which may be replaced when the rear insulator discs are removed from the barrel of the connector. Likewise, the terminals in the rear discs may be replaced if they become damaged so that a wide variety of field repairs may be made to the connector in the event of damage or destruction to the primary contacts or the harnessing system.

DESCRIPTION OF THE PREFERRED EMBODIMENTS

Figure 1:
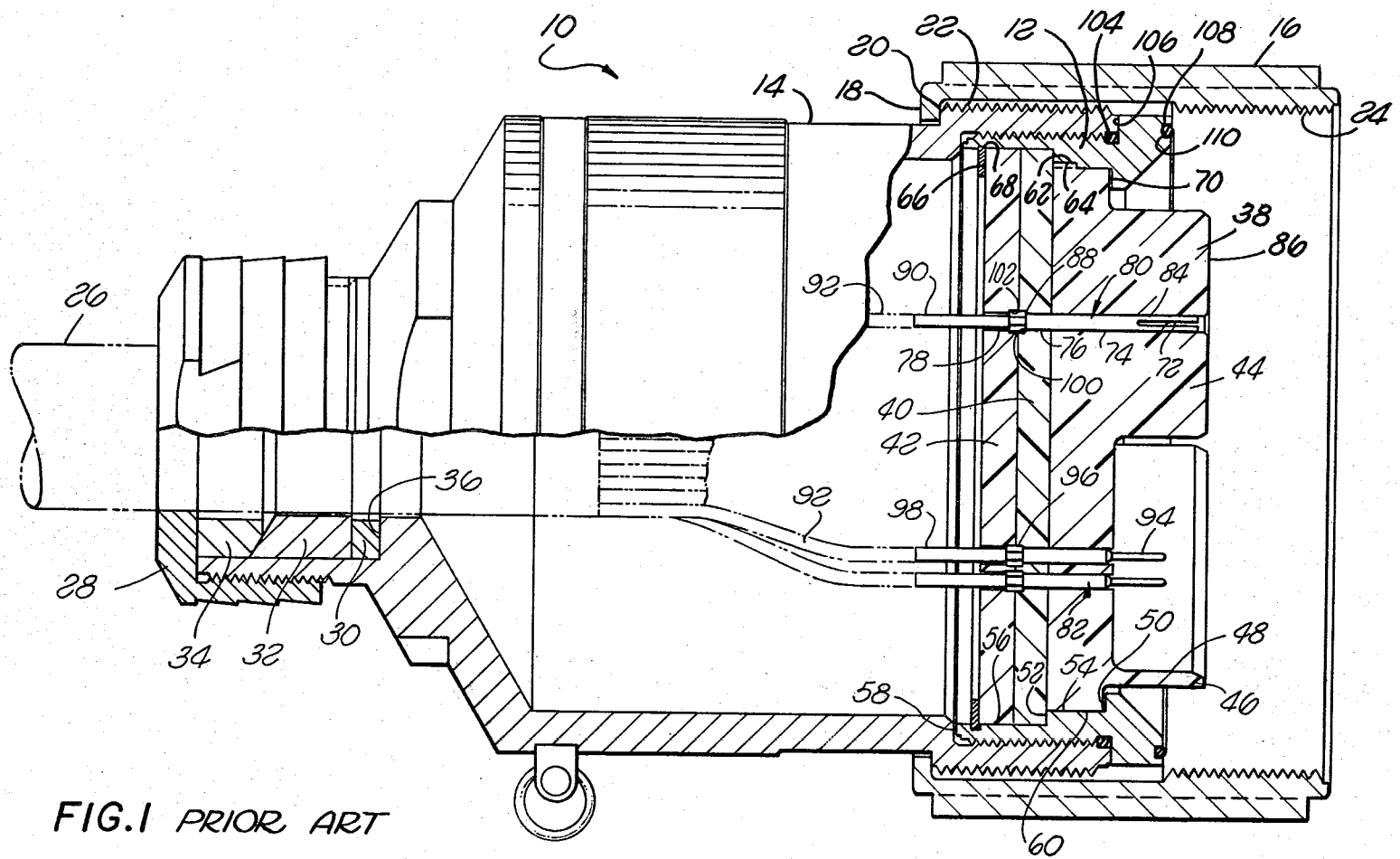
FIG. 1 PRIOR ART
FIG. 1 is a partial longitudinal sectional view of a prior art environmental connector.
Figure 2:
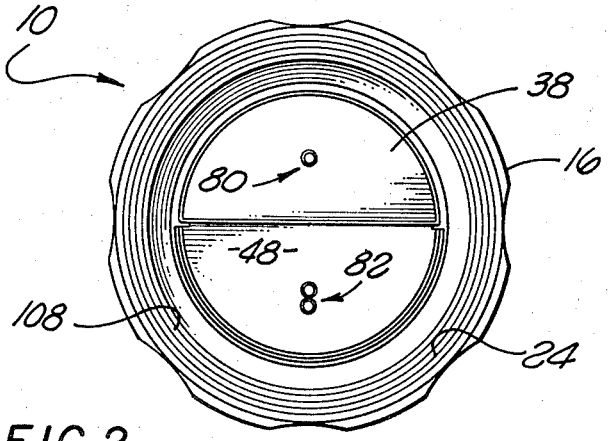
FIG. 2 is a reduced front end view of the connector illustrated in FIG. 1.

First reference is made to FIGS. 1 and 2 which illustrate a prior art geophysical environmental connector of which the present invention constitutes an improvement. The prior art connector, generally designated 10, comprises a barrel 12 having an end bell 14 threadedly engaged over the rear of the barrel. A coupling nut 16 is rotatably mounted on the end bell. The coupling nut embodies a rear inwardly extending flange 18 which abuts a rearwardly facing shoulder 20 formed on the end bell. The forward outer wall portion of the end bell in front of the shoulder 20 is threaded as indicated at 22 while the forward interior wall of the coupling nut 16 is threaded as indicated at 24. The threads 24 match the threads 22 so that the coupling nut 16 may be threaded rearwardly behind the shoulder 20 of the end bell. By this arrangement, the mating connector, not shown, and also provided with an identical coupling nut, embodies an end bell having threads corresponding to the threads 22 illustrated in FIG. 1 which may be coupled with the coupling nut 24 to mate the connector halves together. Conversely, by abutting coupling nuts 24 of both connector halves together and counter-rotating, mechanical separation of the mated connector halves may be accomplished though the resultant axial "jacking" force.

A cable 26 extends into the rear of the end bell 14. The cable passes through a gland nut 28. A front gland washer 30, an elastomeric cable sealing gland 32 and rear gland washer 34 are positioned between a rearwardly facing shoulder 36 on the end bell and the gland nut 28 so that when the nut is threaded tightly onto the end of the end bell, the gland 32 will be compressed inwardly into tight sealing engagement with the cable 26.

An insulator assembly is mounted in the barrel 12 of the connector. Such assembly includes a front insulator 38, a bottom rear insulator 40 and a top rear insulator 42 behind the bottom rear insulator. The front insulator is formed of an elastomeric material while the rear insulators are formed of a relatively hard plastic. The front insulator embodies a forwardly extending solid semi-cylindrical projection 44 opposite to a forwardly extending hollow semi-cylindrical projection 46 which defines therein a recess 48 that is dimensioned to slidably receive a projection 44 of the mating connector member. Thus, the front insulator is in the form of a hermpahorditic connector which allows the connector 10 to mate with an identical connector, not shown. When the mating connector members are interengaged, the projection 44 of the front insulator of one connector member will slide into the recess 48 of the front insulator of the other connector member.

The barrel embodies a pair of annular rearwardly facing shoulders 50 and 52 on its interior surface which are joined by a cylindrical wall portion 54. A larger diameter cylindrical wall 56 extends rearwardly from the shoulder 52 to the rear 58 of the barrel. The rear portion 60 of the front insulator 38 embodies a cylindrical perimeter which tightly engages the cylindrical wall 54 of the barrel to provide a tight sealing fit therebetween. The rear portion of the front insulator also includes a key 62 which fits with a keyway 64 in the wall 54 of the barrel. The outer perimeters of the rear insulators 40 and 42 likewise have a relatively tight fit with the cylindrical wall 56 of the barrel. A snap ring 66 is mounted in a groove 68 in the barrel behind the top rear insulator 42 which retains the front and rear insulators in the barrel. The distance between the retaining ring and the shoulder 50 on the barrel, and the axial lengths of the rear insulators 40 and 42 and of the rear portion 60 of the front insulator is such as to place the rear portion of the front inuslator under axial compression to provide a tight seal between the forwardly facing surface 70 of the insulator and the shoulder 50 on the barrel.

A plurality of contact passages 72 extend axially through the insulator assembly. Each passage comprises a first bore 74 in the front insulator, a second bore 76 in the bottom rear insulator 40 and a third bore 78 in the top rear insulator 42. Socket contacts 80 are mounted in the passage in the upper portion of the insulator assembly as illustrated in FIG. 1, while pin contacts 82 are mounted in the passages in the lower portion of the assembly. Each socket contact embodies a forward socket contacting portion 84 behind the front face 86 of the insulator projection 44, an intermediate annular flange 88 and a rear termination section 90 which is connected to a cable conductor 92 by crimping or soldering. Each pin contact 82 embodies a forward pin contacting portion 94 extending into the recess 48, an intermediate annular flange 96 and a rear termination section 98 connected to another cable conductor 92. Each bore 76 in the insulator 40 has a rearwardly facing annular shoulder 100 therein in front of the flange 88 or 96 and each third bore 78 in insulator 42 has a forwardly facing annular shoulder 102 therein behind the flanges 88 and 96. Such shoulders restrict axial movement of the contacts in their respective passages. Thus, the top and bottom rear insulators together with the snap ring 68 retain the contacts in position in the insulator assembly. It will be noted that because the elastomeric front insulator 38 is compressed when the insulator assembly is fully installed in the barrel 12 of the connector, the walls of the bores 74 in the front insulator will compress around and seal against the bodies of the contacts mountere therein. It is further noted that an elastomeric O-ring 104 is located between the front of the end bell 14 and a rearwardly facing outer shoulder 106 on the barrel while an additional elastomeric O-ring 108 is mounted in an annular groove 110 in the front face of the barrel so that the entire front end of the connector assembly is sealed. Since the rear portion of the assembly is sealed by the sealing gland 32, it will be appreciated that this connector is fully sealed and thus waterproof and resistant to contamination by dust, dirt, etc.

However, field maintenance of the above-described prior art connector cannot be achieved without impairing the seal formed between the front insulator and the barrel. That is, if any of the contacts must be replaced, it is necessary to remove the rear insulators 40 and 42. Because these insulators are tightly fitted in the barrel, they can be removed only by pushing the front insulator 38 rearwardly. Of course, the snap ring 66 must be initially removed in order to remove the rear insulators. Shifting of the front insulator in the barrel and remounting of the insulator into the barrel after repairing a contact, or connection thereto, often results in a complete seal not being formed between the insulator and the barrel thereby imparing the sealing characteristics of the connector. Furthermore, if it becomes necessary to replace a damaged contact or make a new connection between a cable conductor and a contact in the prior art connector, the contact must be removed completely from the insulator assembly and a new crimp or solder connection must be made to the cable conductor, which is time consuming and not easlily performed in the field.

The present invention provides a unique emergency auxiliary harnessing system for the back ends of the contacts which permits quick and reliable emergency field repair in the event of damage to or destruction of any element of the primary contact or harnessing system, and without any impairment of the seal between the front insulator and the barrel of the connector.

Reference is now made to FIGS. 3–10 of the drawings which show the connector of the present invention. In such figures, parts similar to or corresponding to those employed in the connector illustrated in FIGS. 1 and 2 will bear the same reference numerals. It will be noted that the barrel 12 of the present invention is somewhat longer than the barrel in the prior art connector illustrated in FIG. 1 so as to accommodate a rear contact support disc 120 and a strain relief disc 122 behind the disc 120. The two discs are retained in the barrel by a snap ring 124 mounted in an annular groove 126 on the inside of the barrel. Rather than having each cable conductor permanently connected to the rear of a socket contact 80 as in the prior connector, in the present invention a harnessing terminal 128 is provided for each contact which is slidably connected to the rear end of the contact. A similar harnessing arrangement is provided for the pin contacts of the connector, not shown in FIG. 3.

Figure 3:
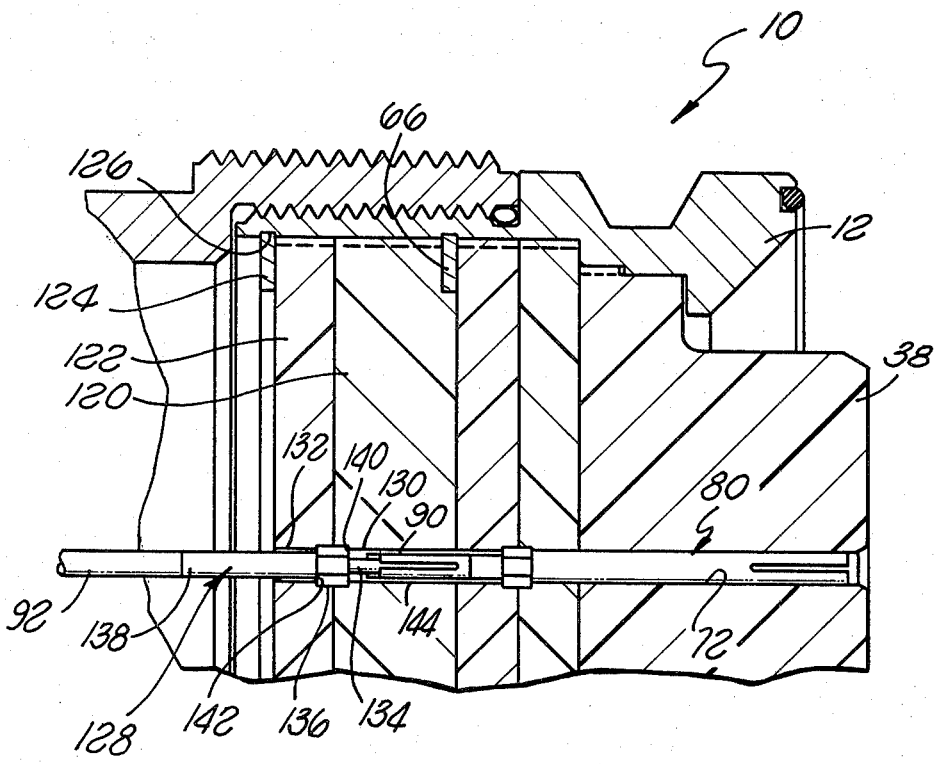
FIG. 3 is a fragmentary longitudinal sectional view through the connector of the present invention.

Each contact passage 72 in the connector illustrated in FIG. 3 includes fourth bore 130 in the rear disc 120 and a fifth bore 132 in the strain relief disc 122. The harnessing terminal 128 is mounted in the bores 130 and 132. The terminal embodies a forward contacting section 134, shown in the form of a pin, an intermediate annular enlargement 136 and a rear termination end 138. The bore 130 has a rearwardly facing annular shoulder 140 in front of the enlargement 136 while the bore 130 has a forwardly facing annular shoulder 142 behind the enlargement to restrict axial movement of the terminal in the discs 120 and 122. In the embodiment illustrated in FIG. 3, the rear portion 90 of the contact 80 is shown as being in the form of a standard split tine socket haing a protective hood 144 mounted thereover. It will be appreciated that the forward pin contacting section 134 of the harnessing terminal slidably engages with the split tine socket contact 90 at the rear of the contact 80. Because the annular enlargement 136 of each contact 80 is trapped between the shoulders 140 and 142 on the discs 120 and 122, the contacts are axially retained and restrained from excessive angular displacement thereby assuring that the forward pin contacting sections 134 of the harnessing terminals are properly positioned and aligned for sliding engagement with the rear socket portions of the contacts 80, thus facilitating a simultaneous intermating of the harnessing terminals and the contacts during assembly even for a very large number of contacts in the connector, such as 128 contacts in each connector half.

The insulators 40 and 42 and the discs 120 and 122 in the connector of the invention have a free sliding fit within the barrel 12 so that by simply removing the snap rings 66 and 124 from the barrel, such insulators may be removed from the barrel without the requirement of pushing the front insulator rearwardly in the barrel, as in the prior art connector, which disturbs the seal therebetween.

In a preferred embodiment of the invention, the rear termination section 90*a* of each contact, whether a pin contact or socket contact, is in the form of a "napkin" spring socket contact similar to that disclosed in my U.S. Pat. No. 4,221,447. Referring to FIGS. 4–7, the rear termination section of such contact comprises a contact body 150 having a longitudinally extending open curved channel 152 therein which is dimensioned to slidably receive the pin 134 of the terminal 128. The "napking" spring is a split spring sleeve 154 which is slidably mounted over the rear body portion 150 of the contact. Reference is made to the aforementioned U.S. Pat. No. 4,221,447 for a detailed description of such spring sleeve, which description is incorporated herein by reference. The hood 144 protects the spring sleeve. By the use of such a contact, if the spring sleeve 154 is damaged, it may be readily removed and replaced since it is simply sidably mounted on the contact body 150, thus avoiding the necessity of removing the contact body from the front insulator.

Figure 9:
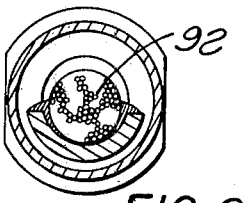
FIG. 9 is a sectional view taken along line 9—9 of FIG. 8.
Figure 8:
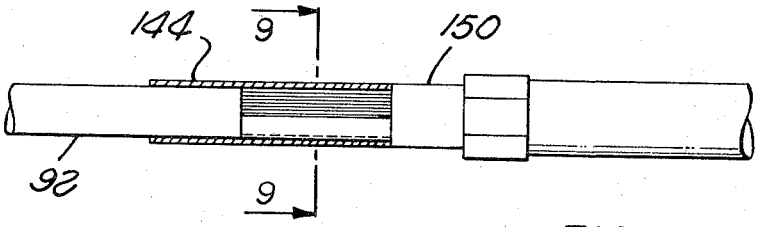
FIG. 8 is a partial longitudinal sectional view of the rear section of a contact body similar to that illustrated in FIG. 5 without the spring sleeve of FIG. 6, but instead with a conductor cable soldered thereto.
Figure 10:
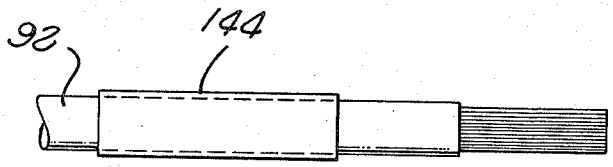
FIG. 10 is a side elevational view of the cable conductor illustrated in FIG. 8 prior to pushing the hood of the contact over the contact body.

If spring sleeves 154 are not available in the field for repairing a connector, or additional harness terminals are not available if one becomes damaged in a connector, it is possible to remove the damaged or old terminal 128 from the conductor 92, slide the hood 144 rearwardly over the conductor as illustrated in FIG. 10 and solder the conductor in the channel formed in the rear of the contact body 150, as illustrated in FIGS. 8 and 9. Thereafter the hood 144 may be pushed forwardly over the solder joint as illustrated in FIG. 8 to protect the joint.

In order to clarify and understand the advantages of the emergency auxiliary harnessing system of the present invention, as provided by the preferred arrangement illustrated in FIGS. 4–7, a number of hypothesized potential failure modes will now be described together with the various capabilities of the connector to compensate for such failures regardless of the cause.

If breakage of a conductor harnessed to a terminal 128 occurs, the following field repair procedure may be followed. First the snap ring 124 is removed from the barrel and the strain relief disc 122 is slid rearwardly over the conductors 92 of the cable away from the barrel assembly. Then the terminal pin 128 is disconnected from the damaged conductor. An appropriate length of the damaged conductor core is bared and then soldered to a new harnessing pin 128. The pin is then inserted into the rear contact support disc 120 and the strain relief disc 122 is pushed forwardly into position as illustrated in FIG. 3. The snap ring 124 is then replaced to complete the assembly.

If a terminal pin 128 is damaged, the field repair procedure is the same as discussed above except that a new pin is soldered or crimped to the cable conductor.

If a spring sleeve 154 becomes damaged, the snap ring 124 is removed and the strain relief disc 122 is slid rearwardly along the conductors 92. The terminal pin 128 of the faulty line is unplugged from the rear socket contact section 90*a* of the contact 80. The hood 144 is then removed together with the damaged spring. A new spring 154 is then mounted on the rear body portion 150 of the contact, the hood 144 is replaced and the strain relief disc 122 is mounted back into the barrel as discussed previously.

If a spring sleeve 154 becomes damaged and no additional springs are available, after removing disc 122 from the barrel, it is necessary to unplug all the terminal pins 128 from the corresponding contacts in the connector. In this case, not only must the strain relief disc 122 be removed, but also the contact support disc 120. The hood 144 is removed from the damaged line as is the damaged spring 154 from the contact body 150. The terminal pin 128 is cut off from the conductor 92 coupled to the damaged line, and the hood 144 is slid rearwardly down the conductor. The end of the conductor is bared and inserted into the exposed arcuate channel in the rear body portion 150 of the contact and is soldered in place. The hood 144 is then slid forwardly along the conductor and snapped into the original position on the contact body, thus bridging the soldered connection and providing a bend relief for the unsupported line prior to reassembly of the discs 120 and 122 in the barrel.

If the socket contact 80 is damaged, both snap rings 124 and 66 are removed and the discs 120 and 122 and the top rear insulator 42 are removed from the barrel so that the contact 80 may be replaced. The insulator and discs are then remounted in the barrel as discussed previously. Obviously, other variations in the field repairability of the connector are available as will be apparent to those skilled in the art.

It will be appreciated that the embodiment illustrated in FIG. 3, utilizing an integral split tine socket 90 at the rear of contact 80, does not allow as great flexibility in field repair as does the embodiment illustrated in FIGS. 4–7.

Figure 4:
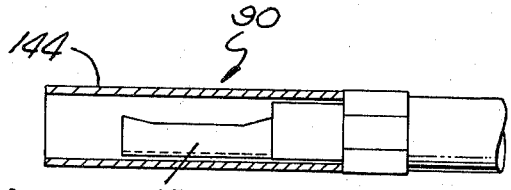
FIG. 4 is a partial longitudinal sectional view through the rear section of one of the contacts utilized in the connector illustrated in FIG. 3.
Figure 5:
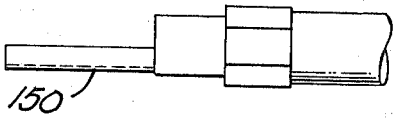
FIG. 5 is a side elevational view of the body of the contact illustrated in FIG. 4.
Figure 6:
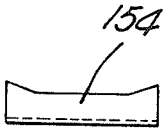
FIG. 6 is a side elevational view of a spring sleeve which is mounted on the body of FIG. 5 to form the contact illustrated in FIG. 4.
Figure 7:
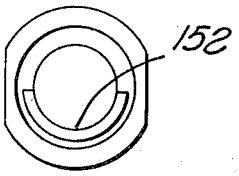
FIG. 7 is a rear end view of the contact body illustrated in FIG. 5.

In a further alternative arrangement, the rear section 90 of the contact 80 may be in the form of a pin contact while the forward contactig section 134 of the harnessing terminal may be in the form of a socket contact, either a split tine or a "napkin" spring type as shown in FIG. 4.

Thus, the connector of the present invention permits quick and reliable emergency field repair in the event of damage or destruction of any of the elements of the connection system. This repair can be effected without damaging the seal produced between the front elastomeric insulator 38 and the connector barrel. Contacts may be replaced in the front insulator and resealed due to the compression mounting of the elastomeric insulator. No adhesives are required for any of the insulators in order to achieve a sealed connector assembly. Furthermore, the connector has a hermaphroditic design eliminating the impossible problem of mating connectors of the same gender.

What is claimed is:

1. An electrical connector comprising:

a barrel containing an insulator assembly comprising, in sequence, a front insulator, a bottom rear insulator, a top rear insulator, a rear contact support disc and a strain relief disc;

said front insulator being formed of an elastomer;

said rear insulators and discs being formed of relatively rigid material and having a free sliding fit within said barrel so as to be rearwardly removable therefrom without pushing said front insulator rearwardly in said barrel;

said front insulator having a forwardly facing shoulder on the outer perimeter thereof engaging a rearwardly facing shoulder on said barrel;

a first retaining ring in said barrel positioned behind said top rear insulator removably retaining said front insulator and said rear insulators in said barrel;

the distance between said first retaining ring and said rearwardly facing shoulder, and the axial lengths of said rear insulators being such as to place said outer perimeter of said front insulator under axial compression to provide a seal between said front insulator and said barrel;

a second retaining ring in said barrel behind said strain relief disc removably retaining said discs in said barrel;

said insulator assembly containing a plurality of contact passages extending axially therethrough, each said passage comprising a first bore in said front insulator, a second bore in said bottom rear insulator, a third bore in said top rear insulator, a fourth bore in said rear contact support disc and a fifth bore in said strain relief disc;

a contact positioned in said first, second, third and fourth bores of each of said passage, and a harnessing terminal positioned in said fourth and fifth bores in each said passage;

each said contact embodying a forward pin or socket contacting portion adjacent to the front face of said front insulator, an intermediate annular flange and a rear contacting section in said fourth bore;

each said second bore having a rearwardly facing shoulder therein in front of the flange of its corresponding contact and each said third bore having a forwardly facing shoulder therein behind said flange, said shoulders restricting axial movement of said contacts in said passages;

each said harnessing terminal embodying a forward contacting section mating with the rear contacting section of a corresponding one said contacts, an intermediate annular enlargement and a rear termination end adapted to be connected to a cable conductor;

each said fourth bore having a rearwardly facing shoulder therein in front of the enlargement of its corresponding terminal and said fifth bore having a forwardly facing shoulder therein behind said enlargement, said shoulders restricting axial movement of said terminals in said passages; and said rear contact support disc and said strain relief disc supporting said terminals in axial positions for alignment with said rear contacting sections of said contacts.

2. An electrical connector as set forth in claim 1 wherein:

said axial compression applied to said front insulator effects a compression seal between the walls of said first bores and said contacts.

3. An electrical connector as set forth in claim 1 wherein:

one of said contacting sections is a pin and the other mating contacting section is a socket having a spring element thereon.

4. An electrical connector as set forth in claim 3 wherein:

said spring element is replaceable.

5. An electrical connector as set forth in claim 3 wherein:

said one contacting section includes a body having a longitudinally extending open curved channel therein receiving said pin; and said spring element comprises a pin-receiving spring sleeve mounted on said body resiliently urging said pin against the wall of said channel, said sleeve being slidable axially off of said body when said discs are removed from said barrel.

6. An electrical connector as set forth in claim 3 including:

a protective hood slidably mounted on said socket over said spring element.

7. An electrical connector as set forth in claim 1 wherein:

an end bell is threadedly engaged with the rear of said barrel; and a seal is provided between said end bell and said barrel.

8. An electrical connector comprising:

a barrel containing an insulator assembly comprising, in sequence, a front insulator, a bottom rear insulator, a top rear insulator, a rear contact support disc and a strain relief disc;

said front insulator being formed of an elastomer;

said rear insulators and discs being formed of relatively rigid material and having a free sliding fit within said barrel so as to be rearwardly removable therefrom without pushing said front insulator rearwardly in said barrel;

said front insulator having a forwardly facing shoulder on the outer perimeter thereof engaging a rearwardly facing shoulder on said barrel;

a first retaining ring in said barrel positioned behind said top rear insulator removably retaining said front insulator and said rear insulators in said barrel;

a second retaining ring in said barrel behind said strain relief disc removably retaining said discs in said barrel;

said insulator assembly containing a plurality of contact passages extending axially therethrough, each said passage comprising a first bore in said front insulator, a second bore in said bottom rear insulator, a third bore in said top rear insulator, a fourth bore in said rear contact support disc and a fifth bore in said strain relief disc;

a contact positoned in said first, second, third and fourth bores of each of said passage, and a harnessing terminal positioned in said fourth and fifth bores in each said passage;

each said contact embodying a forward pin or socket contacting portion adjacent to the front face of said front insulator, an intermediate annular flange and a rear socket section in said fourth bore;

said socket section including a body having a longitudinally extending open curved channel therein, and a pin-receiving spring sleeve mounted on said body for resiliently urging a pin against the wall of said channel, said sleeve being rearwardly slidable off of said body when said discs are removed from said barrel;

a protective hood slidably mounted on said socket body over said spring sleeve;

each said second bore having a rearwardly facing shoulder therein in front of the flange of its corresponding contact and each said third bore having a forwardly facing shoulder therein behind said flange, said shoulders restricting axial movement of said contacts in said passages;

each said harnessing terminal embodying a forward pin mating with the sleeve or a corresponding one said contacts, an intermediate annular enlargement and rear termination end adapted to be connected to a cable conductor;

each said fourth bore having a rearwardly facing shoulder therein in front of the enlargement of its corresponding terminal and each said fifth bore having a forwardly facing shoulder therein behind said enlargement, said shoulders restricting axial movement of said terminals in said passages;

said rear contact support disc and said strain relief disc supporting said terminals in axial positons for alignment with said rear socket sections of said contacts; and the distance between said first retaining ring and said rearwardly facing shoulder, and the axial lengths of said rear insulators being such as to place said front insulator under axial compression to provide a seal between said front insulator and said barrel, and between the walls of said first bores and said contacts.

* * * * *